United States Patent [19]

Crosby

[11] Patent Number: 4,477,081

[45] Date of Patent: Oct. 16, 1984

[54] BOARD GAME WITH NUMBER SELECTION DEVICE

[76] Inventor: Walter R. Crosby, 78 S. Washington Ave., Centereach, N.Y. 11720

[21] Appl. No.: 462,309

[22] Filed: Jan. 31, 1983

[51] Int. Cl.[3] ..... A63F 3/00; A63F 9/00

[52] U.S. Cl. ..... 273/251; 273/138 R; 273/144 R

[58] Field of Search ..... 273/252, 138 R, 144 R, 273/144 A, 145 R, 145 B, 145 C, 139, 120 R, 251

[56] References Cited

U.S. PATENT DOCUMENTS

| | | | |
|---|---|---|---|
| 452,194 | 5/1891 | Prendergast | 273/138 R |
| 958,556 | 5/1910 | Spaulding | 273/248 |
| 2,102,807 | 12/1937 | Perks | 273/138 R |
| 2,601,985 | 7/1952 | Yerkes | 273/120 R |
| 4,134,591 | 1/1979 | Brooks | 273/252 |

FOREIGN PATENT DOCUMENTS

| | | | |
|---|---|---|---|
| 1033570 | 7/1958 | Fed. Rep. of Germany | 273/145 C |
| 1246738 | 10/1960 | France | 273/145 B |

*Primary Examiner*—Richard C. Pinkham
*Assistant Examiner*—Scott Brown
*Attorney, Agent, or Firm*—Kevin Redmond

[57] ABSTRACT

A board game in which the board contains a map of the United States. A track extending from New York to Los Angeles is drawn across the map. Spaces along the track include instructions which apply to each player whose game piece lands on such spaces. These instructions may be to the player's advantage or disadvantage and may, for example, advance or retard the player's movement along the track. The winner must be the first player to complete the round trip from New York to Los Angeles. A novel number selection device, for determining postage and the number of spaces a player advances, comprises in part a funnelform chute with deflection rods to randomly deflect a specially marked, miniature letter into one of several numbered mail bins. The number of the bin into which the letter falls determining the selected number.

9 Claims, 12 Drawing Figures

BOARD GAME WITH NUMBER SELECTION DEVICE

FIELD AND BACKGROUND

This invention relates to games of chance and, more particularly, to board games of chance in which the theme is a major industry such as the postal service.

Most board games have a continuous track on which the players rotate their game pieces about the board. Spaces on the tracks may relate to localized areas such as streets of a town, but rarely relate to locations of broader interest such as the major cities of a country, nor do they generally teach procedures or terminology used in an industry.

SUMMARY

It is an object of the present invention to provide a board game in which the players move their game pieces through simulated post office locations in major cities throughout the country and in which the cities are placed in their actual locations on a map of the United States.

It is an object of the present invention to familiarize the players with some of the terminology and analogous procedures used in the Postal Service by presenting them in the form of an enjoyable game.

The present invention is a board game which includes a board that contains an outline map of the United States and includes a track that winds across the map from New York to Los Angeles. The board serves as a playing field. Each player is assigned a single game piece which is moved along the track in accordance with a number produced by a number selection device. The track is divided into a plurality of spaces containing information relating to player instructions. The number produced by the number selection device determines the number of spaces along the track a player may advance.

The cities at which major post offices are located are noted in appropriate locations along the track. These are safe stopping locations for each player, however, the instructions contained on other spaces may either advance or retard a player's progress.

The number selection device includes a chute placed over a number of miniature mail bins. A series of rods are placed in the chute to randomize the flow of miniature letters dropped into the chute. The miniature letters comprise a plurality of identically colored miniature letters and one specially colored letter. These letters are first placed into a miniature mail bag, shaken and then emptied into the chute. The number of the bin into which the specially marked miniature letter falls determines the number selected. This number is typically used to determine the number of spaces a player is to advance.

A plurality of spaces along the track are marked "FLASH" indicating that a player whose game piece lands on such a space is to draw a card from a deck of "FLASH CARDS". The "FLASH CARDS" contain additional instructions which advance, retard, or cause a player to lose his turn. The instructions in the spaces along the track also contain similar instructions as well as directives to purchase new stamp issues or pay postage.

Each player is issued money at the initiation of the game which may be used for the payment of postage or new stamp issues. The object of the game is to advance from New York to Los Angeles and then return to New York. The first player to accomplish this round trip is the winner of the game. Anyone who runs out of money during the course of the game is considered out of the game.

DESCRIPTION OF THE INVENTION

Figure 1:
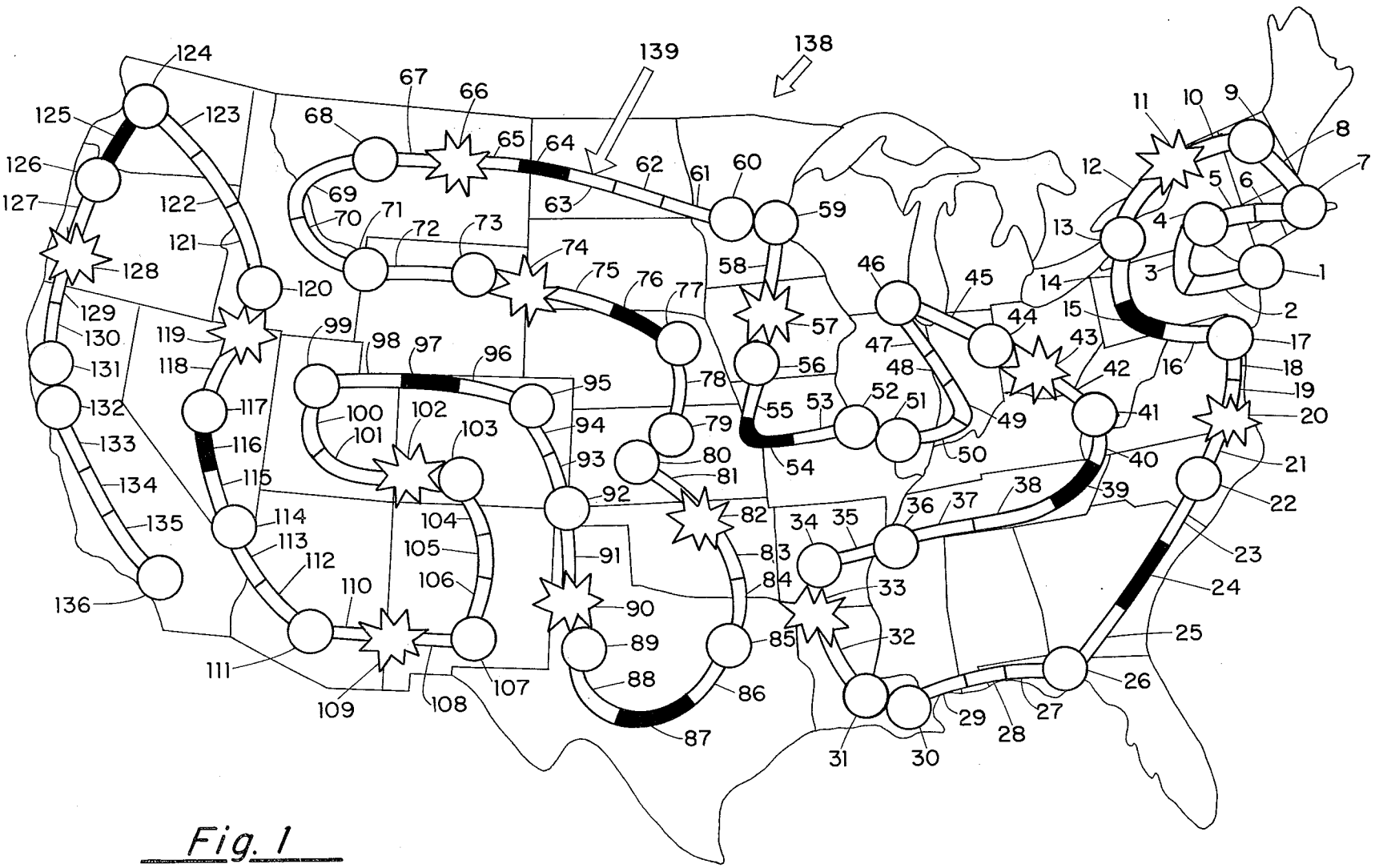
FIG. 1 is an outline map of the United States containing a track winding across the country from New York to Los Angeles.

FIG. 1 shows an outline map of the United States 138 containing a track 139 which winds through the country from New York to Los Angeles, passing through major cities along the way. Each city includes a post office which is indicated by a postage mark consisting of a circle containing the name of the city and its ZIP code. The track is divided into generally contiguous, oblong spaces that contain instructions which direct a player whose game piece lands on the space to advance, go back, lose a turn, pay postage or buy a new stamp issue. Each such space is numbered in FIG. 1 only for purposes of identification. The instructions for each space are normally printed on the space in an actual game where the board and spaces are sufficiently large to make that feasible; however, to make the instructions clear with the smaller map of FIG. 1, the instructions normally printed in each space are listed in Table I.

Figure 4A:
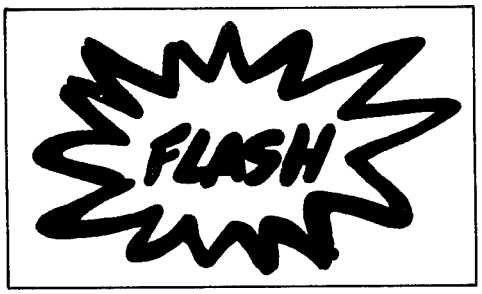
FIG. 4A shows the reverse side of a FLASH CARD.
Figure 4B:
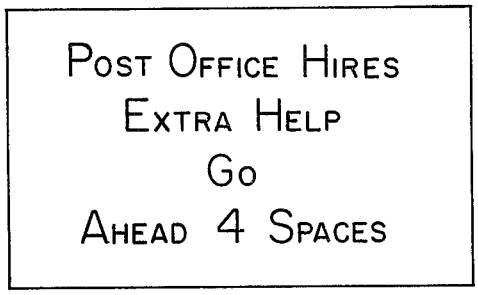
FIG. 4B is a representation of the instruction side of a FLASH CARD.

Disbursed along the track are spaces identified by the word "FLASH" surrounded by a jagged outline. A player whose game piece lands on such a space is directed to draw a FLASH CARD. FLASH CARDs are shown in FIGS. 4A and 4B. FIG. 4A illustrating the reverse side which again contains the word "FLASH" surrounded by a jagged outline, while FIG. 4B illustrates the instruction side of the card. A complete listing of instructions contained on the FLASH CARDs is provided in Table II below.

Table I, List of Spaces

1. New York 10001
2. Slow start try again
3. Letter on its way
4. Woodstock 12498 N.Y.

5. New Stamp Issued
6. Insignificant postage go back to nearest Post Office
7. Boston 02109 Mass.
8. New England blizzard, lose turn
9. Laconia 03246 N.H.
10. No postage go back to nearest Post Office
11. Flash
12. Insignificant postage go back to nearest Post Office
13. Buffalo 14240 N.Y.
14. New Stamp Issued
15. Blank (mail classification)
16. Insignificant postage go back to nearest Post Office
17. Washington 20013 D.C.
18. New Stamp Issued
19. Wrong address start over
20. Flash
21. No postage go back to nearest Post Office
22. Columbia 29201 S.C.
23. New Stamp Issued
24. Blank (mail classification)
25. Insignificant postage go back to nearest Post Office
26. Tallahassee 32302 Fla.
27. New Stamp Issued
28. Road washed out go back 3 spaces
29. Go ahead 3 spaces
30. New Orleans 70113 La.
31. Alexander 71301 La.
32. New Stamp Issued
33. Flash
34. Hope 71801 Ariz.
35. Postage due go back to nearest Post Office
36. Memphis 38101 Tenn.
37. Move ahead 2 spaces
38. No Zip Code go back to nearest Post Office
39. Blank (mail classification)
40. New Stamp Issued
41. Hazzard 41701 Ky.
42. No postage go back to nearest Post Office
43. Flash
44. New Castle 47362 Ind.
45. Dog bites mailman go back 4 spaces
46. Chicago 60607 Ill.
47. Sent to Canada go back to Buffalo
48. New Stamp Issued
49. Undelivered go back to N.Y. and start over
50. No postage go back to nearest Post Office
51. Altamoh 62411 Ill.
52. St. Louis 63155 Mo.
53. New Stamp Issued
54. Blank (mail classification)
55. Go ahead 2 spaces
56. Murray 50174 Iowa
57. Flash
58. No postage go back to nearest Post Office
59. Minneapolis 55401 Minn.
60. Paynesville 56362 Minn.
61. Go ahead 3 spaces
62. Insignificant postage go back to nearest Post Office
63. New Stamp Issued
64. Blank (mail classification)
65. (letter too large for LSM, must be hand sorted go back 5 spaces)
66. Flash
67. Snow storm lose turn
68. Great Falls 59404 Mont.
69. No postage go back to the nearest Post Office
70. Go ahead 6 spaces
71. Alpine 83127 Wyo.
72. Letter lost start over
73. Kaycee 82639 Wyo.
74. Flash
75. New Stamp Issued
76. Blank (mail classification)
77. Silver Creek 68663 Nebr.
78. Plane trouble go back 3 spaces
79. Russell 67665 Kans.
80. Dodge City 67801 Kans.
81. Car hits mail box go back 4 spaces
82. Flash
83. New Stamp Issued
84. No postage go back to nearest Post Office
85. Dallas 75221 Tex.
86. No stamp go back 3 Post Offices
87. Blank (mail classification)
88. Go ahead 2 spaces
89. Crosbyton 79322 Tex.
90. Flash
91. Insignificant postage go back to nearest Post Office
92. Boise City 73933 Okla.
93. Letter missent lose 2 turns
94. Letter on way to Denver Post Office
95. Denver 80202 Colo.
96. New Stamp Issued
97. Blank (mail classification)
98. Letter marked "Fast Delivery" go ahead 2 Post Offices
99. Tooele 84074 Utah
100. Insignificant postage go back to nearest Post Office
101. Road closed due to forest fire lose 2 turns
102. Flash
103. Silverton 81433 Colo.
104. New Stamp Issued
105. No return address go back to Denver Post Office
106. Letter missent to Mexico lose 1 turn
107. Alamogordo 88310 N. Mex.
108. Mail truck overturned lose turn
109. Flash
110. No postage go back to nearest Post Office
111. Phoenix 85026 Ariz.
112. New Stamp Issued
113. Truck broke down go back 4 spaces
114. Las Vegas 89114 Nev.
115. Sandstorm go back to Las Vegas Nev.
116. Blank (mail classification)
117. Austin 89310 Nev.
118. No postage go back 2 Post Offices
119. Flash
120. Ketchum 83340 Ind.
121. New Stamp Issued
122. Missent to Alaska advance to Seattle and lose next turn
123. Insignificant postage go back to nearest Post Office
124. Seattle 98101 Wash.
125. Blank (mail classification)
126. Mt. Angel 97362 Oreg.
127. Letter unreadable lose turn
128. Flash
129. Go back 1 space
130. New Stamp Issued 131. Eureka 95482 Calif.
132. San Francisco 94101 Calif.
133. Smog moves in lose turn
134. Move to L.A. Post Office
135. No postage go back to Post Office
136. Los Angeles 90052 Calif.

Table II List of Flash Cards

1. Letter damaged in delivery. Go back to nearest Post Office
2. Postage increase. Go back to nearest Post Office and pay 15 cents.
3. Lose two turns.
4. Priority letter. Move to nearest Post Office.
5. Fire in Post Office. Go back to nearest Post Office.
6. Move ahead to local Post Office. Letter went air mail.
7. Holiday. Lose next turn.
8. Wild cat strike. Post Office closes. Lose next turn.
9. New letter sorting machine installed. Go ahead 3 spaces.
10. Grand opening of new Post Office. Go ahead 4 spaces.
11. Post Office issues new stamp. Stay where you are and pay 75 cents.
12. Go on tour of Post Office. Stay where you are.
13. Post Office hires extra help. Go ahead 4 spaces.
14. Extra delivery of mail. Go ahead 5 spaces.
15. Christmas rush. Mail overflow. Lose next turn.
16. Go again.

It can be seen from Tables I and II that numerous terms and operations associated with the Postal Service are present. Although exact postal operating procedures are not included in a game, which is designed for wide usage and enjoyment, elements of the terminology and a number of postal procedure concepts are definitely present. Of course, specific and detailed information relating to U.S. Postal procedures should be obtained directly from the U.S. Postal Service.

Figure 2:
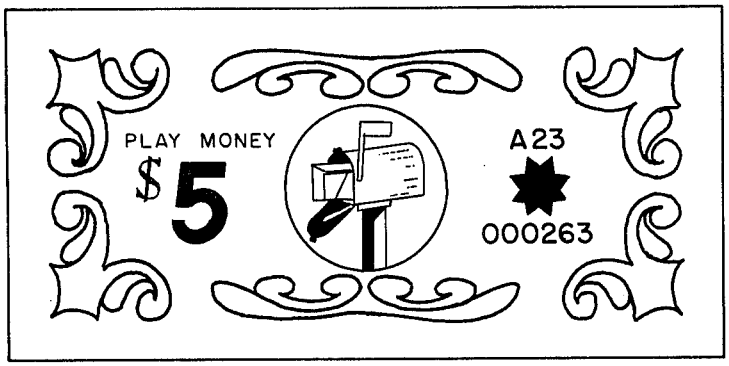
FIG. 2 is a representative sample of play money issued to each player.

Play money as shown in FIG. 2 is available in five-dollar, one-dollar, fifty-cent, twenty-five cent, ten-cents and five-cent denominations. The money is typically made of paper and is identical to that shown in FIG. 2 except for the value which is printed on the bill.

Figure 3:
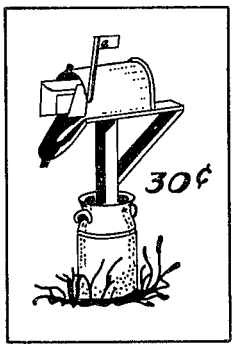
FIG. 3 is a representative sample of a postage stamp used for new issues and postage in the game.

Play stamps as shown in FIG. 3 are available in 30, 25, 20, 15 and 5 cent denominations. The stamps are typically made of paper and are identical to that shown in FIG. 3 except for the value which is printed on the stamp.

Figure 5A:
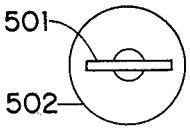
FIG. 5A is a plan view of a playing piece consisting of a miniature letter on a pedestal.
Figure 5B:
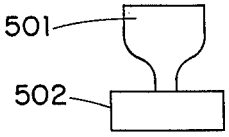
FIG. 5B is a side elevation view of the playing piece of FIG. 5A.

A typical playing piece is shown in FIGS. 5A and 5B. It consists of a miniature letter 501 located on a pedestal 502. The playing pieces are typically identified by color, but any suitable identification method such as numbering may be substituted.

The number selection devices is shown in FIGS. 6A through 6E. The device consists of a funnelform chute comprising a flared mouth 601 and a neck 602. The chute is positioned over a plurality of miniature mail bins 603. Each of the bins carry a number identification such as number 1 denoted by drawing numeral 604. The neck of the chute contains a plurality of ports such as port 605 to accept a plurality of rods such as rod 606. The location of the rods in the neck can be seen more clearly in the plan view of FIG. 6E.

Figure 6B:
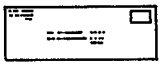
FIG. 6B is a uniformly marked miniature letter used in the number selection device.
Figure 6C:
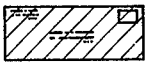
FIG. 6C is a specially marked miniature letter used in the number selection device.
Figure 6E:
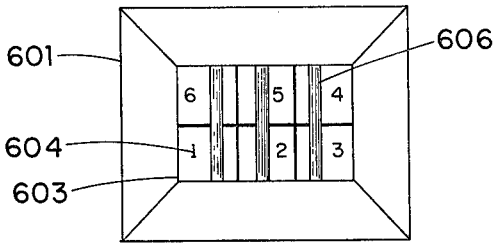
FIG. 6E is a plan view of the number selection device, illustrating the deflection rods used to insure random selection of numbers.
Figure 6A:
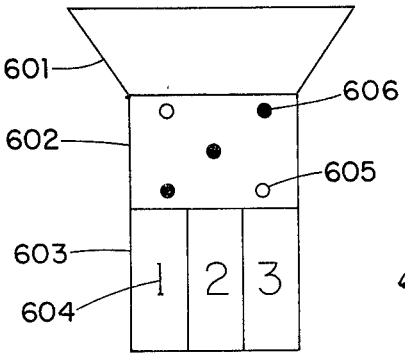
FIG. 6A is a side elevation view of the number selection device.
Figure 6D:
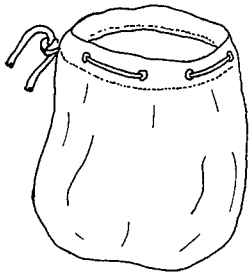
FIG. 6D is a miniature mail bag used to mix the miniature letters of FIG. 6A and 6B.

The number selection device operates using a plurality of uniformly marked miniature letters as shown in FIG. 6B and one specially marked envelope as shown in FIG. 6C. These miniature letters are placed in a miniature mail bag shown in FIG. 6D, shaken and then dumped into the mouth of the chute 601 where they tumble downward, being randomly deflected by the rods into the mail bins. The number of the bin into which the specially marked letter finally comes to rest determines the number generated by this device. Note that the position of the rods may be moved from time to time to further insure the randomness of the number generation.

In the preparation for the game, the board, which is typically folded initially, is opened to expose the playing field. The field consists of the map of the United States and a printed track running from New York to Los Angeles. The FLASH CARDs are shuffled. Each player selects a playing piece and sets it on the space marked New York. Each player is issued ten-dollars, as follows: one five-dollar bill, three one-dollar bills, two fifty-cent bills, three twenty-five cent bills, two ten-cent bills and one five-cent bill.

One person is selected as a window clerk. His duties include handling the money, and also issuing the stamps. If this person is also a player, he must keep the bank and stamps he handles as window clerk separate from those issued to him as a player. During the course of the game the players will be required to purchase stamps. All stamps will be purchased from the window clerk and only from the window clerk.

In playing the game, the number selection device is operated by each player in succession. The player receiving the highest number goes first. All others go in order clockwise around the board. The number selection device is operated for each player as his turn comes up. The number produced determines the number of spaces a player may progress along the track. Once a player lands on a spot, the player must follow the instructions on that spot.

When a player reaches Los Angeles, he starts back for New York; however, on the way back all postage has been "prepaid" and he may ignore any instructions to pay postage. The first player to reach New York is the winner.

There are a number of special game rules as well as a number of the instructions on the spaces that require additional explanation. When the space containing the instruction "no postage Go back to the nearest Post Office" is landed upon, the player must go back to the nearest post office and operate the number selection device to determine the amount of postage which must be paid to the window clerk. The postage payment schedule is as follows:

Generating a 1 or a 2 requires payment for special delivery of 40 cents.

Generating a 3 or a 4 requires payment for first class of 20 cents.

Generating a 5 or a 6 requires payment for bulk rate of 10 cents.

The symbol for each post office is a postage mark formed of a circle enclosing the name of the city and the zip code. The Post Office is a safe location on which to land with a playing piece as there are no penalties.

When a player's playing piece lands on a space with the instruction "mail classification", the player operates the number selection device and then carries out the following steps:

Selecting a 1 or a 2 indicates special delivery. Move ahead 4 spaces.

Selecting a 3 or a 4 indicates first class. Do not move.

Selecting a 5 or a 6 indicates bulk rate. Go back 4 spaces.

When a player's playing piece lands on a space with the instruction "New Stamp Issued", the player operates the number selection device and then the player purchases a number of twenty-cent stamps equal to the number produced by the number selection device.

When a player's playing piece lands on a space with the instructions "insignificant postage" the player operates the number selection device and the player pays postage in accordance with the following schedule:

Selecting a 1 or a 2 indicates special delivery and a payment of 15 cents.

Selecting a 3 or a 4 indicates first class and a payment of 10 cents.

Selecting a 5 or a 6 indicates bulk rate and a payment of 5 cents.

A player may use stamps he has previously purchased to pay for the above insignificant postage.

During the return trip from Los Angeles to New York a paper clip is placed on the playing piece to distinguish it from playing pieces going to Los Angeles.

Any player who runs out of money is out of the game. He cannot borrow money or stamps from any player or from the window clerk.

If one playing piece lands on the same space occupied by another playing piece, both are considered as going to the same state. Both will move ahead two spaces.

If one playing piece lands on the same space occupied by two other playing pieces, it is considered that the first three numbers of the zip codes of these letters (playing pieces) are the same for each piece and all will move to the nearest post office.

If one playing piece falls on the same space occupied by three playing pieces or more, they are considered "a direct" and all will move ahead two post offices. "A direct" means that all five numbers of the zip code are the same.

All of the immediately above special rules apply to letter pieces going in the same direction only.

A number of variations of the present invention are possible, but such variations are considered as remaining within the spirit and scope of the invention. For example, in the operation of the number selection device one of the mail bins may be marked special, while the miniature letters are numbered. The number of the letter falling into the bin marked special is the selected number. Where two or more letters fall into the bin marked special, the miniature letter with the highest number is used. Other such variations include dropping the miniature letters directly into the chute without the use of the mail bag, or conversely dropping the miniature letters from the mail bag directly into the bins without the use of the chute.

Having described my invention, I claim:

1. A board game apparatus, comprising:

(a) a board acting as a playing field and containing on one side an outline map of the United States of America, (b) a track winding across the map between New York and Los Angeles, (c) a single playing piece for each player to be used in accordance with the rules of the game in which the piece is moved along the track, (d) a plurality of spaces along the track containing indications of location and instructions to be followed when a player's playing piece lands on a space containing such instructions, and (e) a number selection device to determine the number of spaces each player moves along the track, comprising:

(i) a funnelform chute, (ii) a plurality of moveable, partial barriers positioned in the chute, (iii) a plurality of miniature numbered mail bins positioned below the chute, (iv) a miniature mail bag, (v) a plurality of uniformly identified miniature letters, initially positioned in the miniature mail bag, (vi) a single miniature letter having a special identification which differs from those in subparagraph (v) above and which is positioned initially in the miniature mail bag where it is mixed with the letters of subparagraph (v) by shaking the bag, all letters in the bag then being emptied into the chute, passed randomly through the barriers, and into one of the numbered mail bins, the number of the bin into which the special letter falls determining a selected number that is typically used to indicate the number of spaces moved by a player.

2. Apparatus as claimed in claim 1, wherein a plurality of spaces are marked "FLASH" and said apparatus further comprises a plurality of cards with "FLASH" marked on one side and instructions on the other which are to the advantage and disadvantage of a player's progress on the track, a player being required to draw a "FLASH" card and following the instructions thereon when his playing piece lands on a space marked "FLASH".

3. Apparatus as claimed in claim 2, wherein each playing piece is in the form of a miniature letter on a pedestal and each is marked to separately identify it thereby identifying the progress along the track of a player to which a piece is assigned.

4. Apparatus as claimed in claim 3, wherein each playing piece is identified by an individual color and is further identified as to direction of travel by the addition of a paper clip on the return trip from Los Angeles to New York.

5. Apparatus as claimed in claim 1, wherein the playing piece is advanced by each player in accordance with the rules of the game and the instructions on the spaces from New York to Los Angeles and back, the first player to complete the round trip being the winner of the game.

6. Apparatus as claimed in claim 1, wherein the special letter in the number selection device is identified by a color differing from that of the remaining letters described in subparagraph (v) of claim 1.

7. Apparatus as claimed in claim 1, wherein the partial barriers consists of rods positioned in the chute, the chute containing a plurality of ports in its sides to permit the rods to be passed through and supported by the chute, the plurality of the ports in the chute permitting a variety of random positions for the rods to provide a variety of paths for the letters to pass and thereby insure a completely random number section.

8. Apparatus as claimed in claim 7, wherein game money is issued to each player in a fixed amount at the initiation of the game to enable the player to make payment in accordance with the instructions, a player who runs out of money during the game being considered out of the game.

9. Apparatus as claimed in claim 1, wherein the instructions on the spaces and the FLASH card includes directions which advance or retard position, cause the loss of a turn, charge postage and charge for a new stamp issues.

* * * * *